US006379512B1

(12) United States Patent
Brown et al.

(10) Patent No.: US 6,379,512 B1
(45) Date of Patent: Apr. 30, 2002

(54) COMBINATION FOR ELECTROLYTIC REDUCTION OF ALUMINA

(75) Inventors: Craig W. Brown; Richard J. Brooks, both of Seattle; Patrick B. Frizzle, Lynnwood, all of WA (US); Drago D. Juric, Bulleen (AU)

(73) Assignee: Northwest Aluminum Technology, The Dalles, OR (US)

( * ) Notice: Subject to any disclaimer, the term of this patent is extended or adjusted under 35 U.S.C. 154(b) by 0 days.

(21) Appl. No.: 09/721,846

(22) Filed: Nov. 25, 2000

Related U.S. Application Data

(62) Division of application No. 09/247,196, filed on Feb. 9, 1999, now Pat. No. 6,258,247.
(60) Provisional application No. 60/074,373, filed on Feb. 11, 1998.

(51) Int. Cl.[7] ..... C25C 3/00; C25B 11/04
(52) U.S. Cl. ..... 204/245; 204/291; 204/292; 204/294
(58) Field of Search ..... 205/394; 204/245, 204/291, 292, 294

(56) References Cited

U.S. PATENT DOCUMENTS 3,951,763 A * 4/1976 Sleppy et al. ..... 205/394
4,544,469 A * 10/1985 Boxall et al. ..... 204/245 X
5,006,209 A * 4/1991 Beck et al. ..... 204/291 X
5,284,562 A * 2/1994 Beck et al. ..... 204/245 X

* cited by examiner

*Primary Examiner*—Donald R. Valentine
(74) *Attorney, Agent, or Firm*—Andrew Alexander

(57) ABSTRACT

An electrolytic bath for use during the electrolytic reduction of alumina to aluminum. The bath comprises molten electrolyte having the following ingredients: $AlF_3$ and at least one salt selected from the group consisting of NaF, KF, and LiF; and about 0.004 wt. % to about 0.2 wt. %, based on total weight of the molten electrolyte, of at least one transition metal or at least one compound of the metal or both. The compound is, a fluoride; oxide, or carbonate. The metal is nickel, iron, copper, cobalt, or molybdenum. The bath is employed in a combination including a vessel for containing the bath and at least one non-consumable anode and at least one dimensionally stable cathode in the bath. Employing the instant bath during electrolytic reduction of alumina to aluminum improves the wetting of aluminum on a cathode by reducing or eliminating the formation of non-metallic deposits on the cathode.

20 Claims, 5 Drawing Sheets

COMBINATION FOR ELECTROLYTIC REDUCTION OF ALUMINA

This application is a divisional of U.S. application Ser. No. 09/247,196 filed Feb. 9, 1999 now U.S. Pat. No. 6,258,247, which claims the benefit of U.S. Provisional Application No. 60/074,373, filed Feb. 11, 1998.

The work described herein was partially funded by Pacific Northwest National Laboratory, a unit of the U.S. Department of Energy, operated by Battelle Northwest; the contract number is 310468-A-UF.

BACKGROUND OF THE INVENTION

The present invention relates generally to methods and apparatuses for the electrolytic reduction of alumina to aluminum. More particularly, the subject matter herein is related to the subject matter disclosed in the following U.S. patents of Beck et al.: 4,592,812, 4,865,701, 5,006,209 and U.S. Pat. No. 5,284,562, and the disclosures thereof are incorporated herein by reference.

The aforementioned patents of Beck et al. are directed to a series of developments relating to the electrolytic reduction of alumina to aluminum. The developments culminated in an electrolytic reduction cell containing a relatively low melting point, molten electrolyte composed of fluorides, a non-consumable anode composed of a particular alloy of copper, nickel and iron, and a cathode, composed of titanium diboride ($TiB_2$), that is wettable by molten aluminum. A plurality of the non-consumable anodes are vertically disposed within a vessel containing a bath composed of molten electrolyte. A plurality of the cathodes are also vertically disposed within the vessel, with the cathodes being arranged in close, alternating, spaced relation with the vertically disposed anodes. In a preferred embodiment, the vessel has an interior metal lining electrically connected to the anodes and having essentially the same composition as the anodes; the lining functions as an auxiliary anode.

The bath of molten electrolyte contains some dissolved alumina and is saturated with additional alumina in the form of finely divided particles. The molten electrolyte has a density less than the density of molten aluminum and less than the density of alumina. As noted above, some alumina is dissolved in the molten electrolyte. When an electric current is passed through the bath, aluminum ions are attracted to the cathodes, and oxygen ions are attracted to the anodes. Bubbles of gaseous oxygen form at each of the anodes, and metallic aluminum forms at each of the cathodes. The bubbles of gaseous oxygen pass upwardly from the anodes and maintain the undissolved, finely divided alumina particles suspended in the bath of molten electrolyte, forming a slurry. The metallic aluminum formed at the cathodes wets the surface of each cathode and flows downwardly along the cathode.

The electrolytic reduction cell is operated at a relatively low temperature, substantially below 950° C. The composition of the electrolyte employed in the cell enables one to operate the cell at a relatively low temperature, because the electrolyte is molten at that low temperature. The low cell temperature allows one to use non-consumable anodes composed of the Ni—Cu—Fe alloys described below without subjecting the anodes to deterioration in the molten electrolyte. However, when the cell is operated with a molten electrolyte having a temperature below about 800° C., certain problems can occur. Low solubility of aluminum oxide can lead to a deficiency of aluminum ions at the cathodes, causing a localized change of bath composition and cathode deposits. The deposits form on the surface of the titanium diboride cathode; these deposits interfere with the wetting of the cathode surface by metallic aluminum. In addition, a thin deposit forms around balls containing metallic aluminum that has separated from the cathode preventing the aluminum in these balls from agglomerating into a continuous phase of molten aluminum. Instead, the balls, containing metallic aluminum that has been coated with deposit, remain suspended within the molten electrolyte. The balls that discharge back into the bath back-react, causing poor current efficiency.

The deposits on the cathode are (a) cryolite (25 mol % NaF-75 mol % $AlF_3$) or (b) cryolite and a suboxide of aluminum together with alumina. The deposit on the small balls containing aluminum is believed to be electrolyte and/or alumina. The root cause of the deposits on the cathode and on the balls containing metallic aluminum is believed to be insufficient dissolution of alumina in the electrolyte, particularly at locations adjacent the cathodes.

On start-up, the cathode deposits can form quickly. Once formed, the deposits can persist throughout a run with poor aluminum recovery and low current efficiency. The deposit that appeared to be cryolite was an even grey deposit that would not melt at low operating temperatures. Cryolite deposits can be formed with higher current densities, a low concentration of aluminum fluoride, and coarse alumina feed.

A lumpy, black deposit formed at modest current densities. This deposit has a composition not unlike the bath composition. The black color may be from the formation of a suboxide of aluminum, which is a black semiconductor. Roasting these deposits in air at higher temperatures turns them white. Inspection of these deposits with x-ray fluorescence shows them to be similar to the bath in composition. Cathode deposits are accompanied by a grey bath color, which appears to be associated with aluminum discharge back into the bath from the non-wetted cathode.

Initial deposits may be formed by metal sulfides formed from aluminum sulfate or other sulfur compounds. Aluminum sulfate is an impurity in some smelter grade aluminum fluoride and it enters the bath with the aluminum fluoride feed. Sulfate ion is reduced by aluminum to sulfides, and perhaps to $SO_2$, $SO_3$, and sulfur. Soon after reduction of the sulfate ion, the bath is purged of sulfur.

Known expedients for increasing dissolution of alumina in the electrolyte can reduce or eliminate formation of the deposits, but these known expedients have drawbacks. More particularly, one known expedient is to increase the temperature of the electrolyte substantially above 800° C.; however, this expedient has the drawback of causing the anodes to deteriorate more rapidly.

Another known expedient is to increase the proportion of alumina dispersed in the molten electrolyte; however, an increase in the proportion of alumina increases the voltage required to operate the cell, and this in turn increases energy consumption which is undesirable.

Yet another approach is to pick an intermediate bath temperature, increasing alumina solubility, but also increasing electrode corrosion rate.

Still another known expedient for increasing the dissolution of alumina in the electrolyte is to reduce the current density (defined below), but this compromises the small footprint advantage obtained by employing a multiplicity of vertically disposed, alternating, spaced apart anodes and cathodes in the electrolytic reduction cell.

More particularly, current density is directly proportional to current and inversely proportional to the area of the anode which faces the cathode. The conventional electrolytic reduction cell employs a single horizontally disposed anode and a single horizontally disposed cathode. In order for a cell having a single horizontally disposed anode and cathode to provide a given, relatively low, current density, the required area of the facing surfaces of the two electrodes must be relatively large, and the cell will accordingly occupy a relatively large horizontal area or footprint. When one employs a multiplicity of vertically disposed, alternating, spaced apart anodes and cathodes, the same required area for the electrodes is distributed among the multiplicity of anodes and cathodes. Because the electrodes are vertical and closely spaced, together they occupy a relatively small horizontal area; accordingly, a cell containing such a vertically disposed arrangement of electrodes has a relatively small footprint.

In order to reduce the current density in cell comprising the vertically disposed electrodes described above, one must increase the number of electrodes in the cell. This enlarges the cell and its footprint, thereby compromising the small footprint advantage, described above.

SUMMARY OF THE INVENTION

One aspect of the present invention is a bath for use in the electrolytic reduction of alumina to aluminum. In accordance with the present invention, the aforementioned deposits on the cathode and on the balls containing metallic aluminum are substantially reduced or eliminated, without using any of the expedients described above. This is accomplished by employing a bath comprising a molten electrolyte having the following ingredients: (a) $AlF_3$ and at least one salt selected from the group consisting of NaF, KF, and LiF; and (b) about 0.004 wt. % to about 0.2 wt. %, based on total weight of the molten electrolyte, of at least one transition metal or at least one compound of the metal or both. The electrolyte can comprise about 0.004 wt. % to about 0.02 wt. % of ingredient (b). Alternatively, the electrolyte can comprise about 0.02 wt. % to about 0.1 wt. % of ingredient (b). The compound may be selected from the group consisting of fluorides, oxides, and carbonates. Ingredient (b) can comprise a plurality of metals or of compounds containing metals. The metal or metals can be selected from the group consisting of nickel, iron, copper, cobalt, and molybdenum.

The bath can further comprise alumina in the form of particles having a mean size, expressed as equivalent spherical diameter, of between about 1 micron and about 10 microns. The alumina particles can have a mean size, expressed as equivalent spherical diameter, of between about 1 micron and about 2 microns.

The electrolyte can consist essentially of $NaF/AlF_3$ eutectic and ingredient (b). Alternatively, the electrolyte can consist essentially of $KF/AlF_3$ eutectic and ingredient (b). The electrolyte can consist essentially of $NaF/AlF_3$ eutectic, $KF/AlF_3$ eutectic, 4% LiF, and ingredient (b). The electrolyte includes dissolved alumina which is typically present in the mount of 1–2 wt. %. The bath can be substantially free of sulfur-containing compounds.

It is postulated that the addition of these ingredients, in catalytically small amounts, catalyzes the dissolution of aluminum oxide, particularly the aluminum oxide adjacent the cathode surface on which the metallic aluminum forms. As a result, the formation of deposits on the cathode surface are prevented, or, if such deposits tend to form initially, they are eliminated or reduced. Similarly, the formation of a deposit around the balls containing metallic aluminum is prevented or eliminated.

The net result is that the surface of the cathode, whether the cathode comprises titanium diboride, a composite of titanium diboride and graphite, or molybdenum, is wetted with a layer of metallic aluminum.

Another aspect of the invention is a combination for use in the electrolytic reduction of alumina to aluminum. The combination comprises a vessel, a molten electrolyte bath contained within the vessel, and at least one non-consumable anode in the bath and at least one dimensionally stable cathode in the bath, with a space defined between the anode and the cathode. The bath can comprise ingredients such as ingredients (a) and (b) as summarized above for the bath aspect of the present invention. The bath also comprises alumina particles as described above, and the bath can have an alumina content in a range of about 5 wt. % to about 15 wt. % based on a total weight of the electrolyte bath.

The anode of the combination can be composed of Cu—Ni—Fe alloy. The cathode can be composed of a material selected from the group consisting of $TiB_2$, a composite of $TiB_2$ and graphite, and molybdenum. The combination can comprise means for withdrawing molten aluminum directly from the cathode to remove the molten aluminum from the vessel. The combination can comprise means, such as metallic aluminum, disposed in the vessel for removing sulfur from the bath.

A further aspect of the invention is a method for the electrolytic reduction of alumina to aluminum in a cell containing a cathode and for minimizing non-metallic deposits from the bath on the cathode. The method comprises the steps of: providing a molten electrolyte bath comprising the following ingredients: (a) $AlF_3$ and at least one salt selected from the group consisting of NaF, KF, and LiF; and (b) about 0.004 wt. % to about 0.2 wt. %, based on a total weight of the molten electrolyte bath, of a transition metal or at least one compound of the metal or both. Further steps include providing within the bath at least one non-consumable anode and at least one dimensionally stable cathode; introducing finely divided alumina particles into the bath; passing an electric current through the bath; and forming metallic aluminum at the cathode. Ingredients (a) and (b) of the bath can be varied as described above for the bath aspect of the present invention.

The method can further comprise the step of withdrawing the molter aluminum directly from the cathode to remove the molten aluminum from the cell.

The method can comprise the step of maintaining the bath at a temperature below about 950° C. The method can also comprise the step of maintaining the bath at a temperature in the following ranges: about 850° C. to about 900° C.; about 680° C. to about 800° C.; and about 730° C to about 760° C.

The anode may be composed of Cu—Ni—Fe alloy. The cathode may be composed of a material selected from the group consisting of $TiB_2$, a composite of $TiB_2$ and graphite, and molybdenum. The cathode can comprise a V-shaped member, substantially parallel plates, or other shapes that define a reservoir for the accumulation of aluminum. Conventional plate cathodes are also suitable.

The method can comprise the step of removing at least some sulfur from the bath, such as by providing metallic aluminum in the bath, prior to the step of passing an electric current through the bath. The method can also comprise the step of removing substantially all sulfur from the bath prior to the step of passing an electric current through the bath.

In another embodiment of the present invention, the molten metallic aluminum that wets the surface of the cathode is withdrawn from the cell without breaking electrical contact between the aluminum and the cathode.

In still another embodiment of the present invention, catalytically small amounts of the addition ingredient described above are employed in a high temperature electrolyte bath (e.g. substantially above 800° C.) to facilitate the dissolution of the alumina in that type of bath. Facilitating dissolution of alumina in an electrolyte bath facilitates the electrolytic reduction of the alumina to aluminum, whatever the temperature of the bath.

A further embodiment of the present invention utilizes the tendency of some of the addition ingredient, when the latter is in metallic form, to alloy with the aluminum. This tendency is employed in the present invention to form, directly in the electrolytic reduction cell, aluminum-base alloys also containing the metal of the addition ingredient. This eliminates an additional processing step, namely, adding the metallic addition ingredient to the metallic aluminum, outside of the electrolytic reduction bath, in order to form the alloy in question.

Other features and advantages are inherent in the subject matter described herein or will become apparent to those skilled in the art from the following detailed description in conjunction with the accompanying diagrammatic drawings.

DETAILED DESCRIPTION

Figure 1:
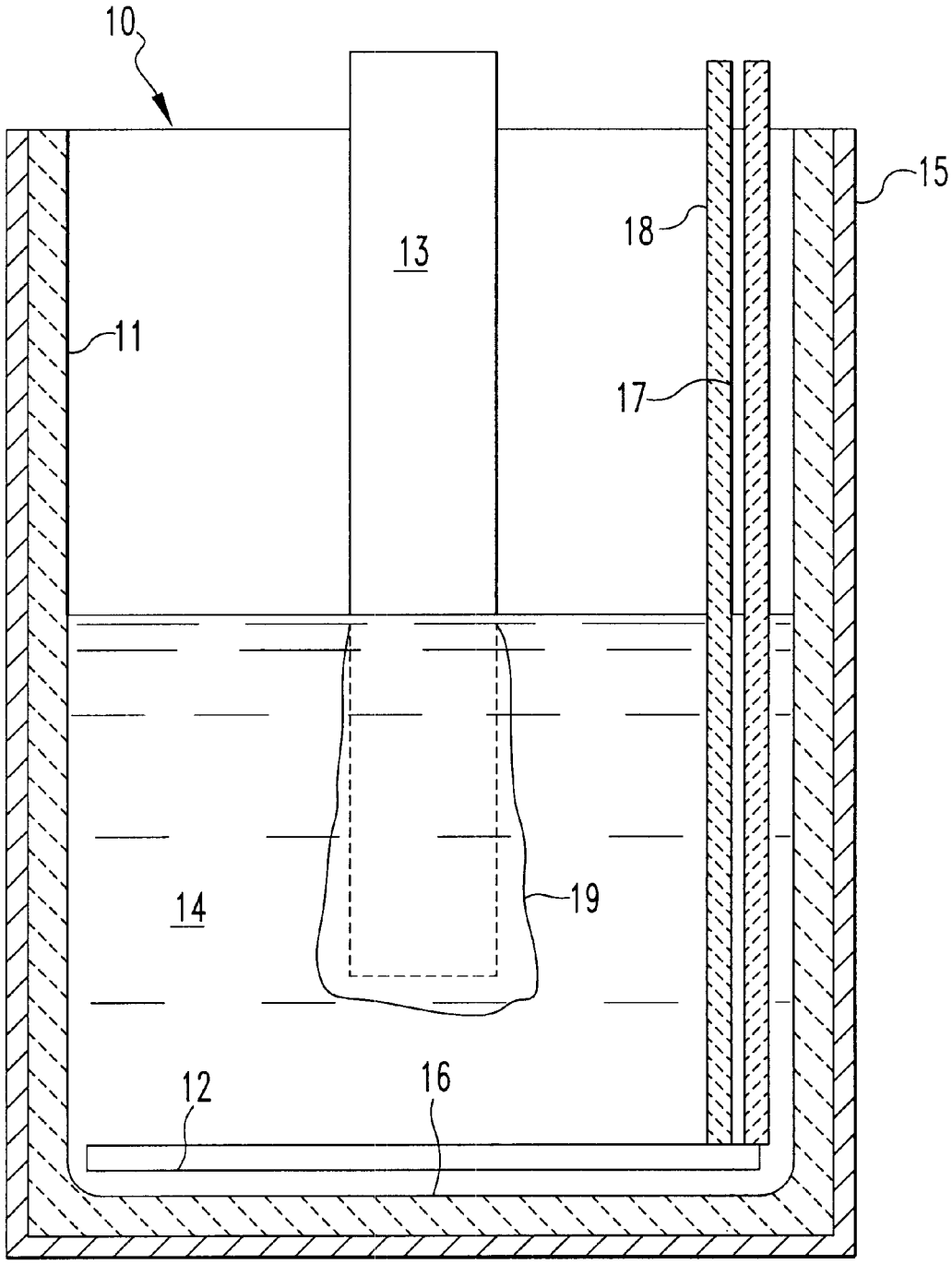
FIG. 1 is a vertical sectional view of a test cell employed in connection with some of the work described herein.

Referring to FIG. 1, indicated generally at 10 is a laboratory cell for the electrolytic reduction of alumina to aluminum. Cell 10 comprises an alumina crucible 11 containing an anode 12, a cathode 13,, and a molten electrolyte bath 14. Alumina crucible 11 is positioned within a stainless steel retaining can 15. As shown in FIG. 1, the inner surface of the sidewall of can 15 and the outer surface of the sidewall of crucible 11 are in abutting relation. In actual practice, a space can exist between the respective sidewalls of can 15 and crucible 11. In such a case, the space is filled with graphite particles to assist in the uniform distribution of heat to the sidewall of crucible 11.

Cathode 11 is typically a slab of titanium diboride, a composite of titanium diboride and graphite, or molybdenum. Anode 12 is in the form of a metal disc overlying and substantially covering the bottom 16 of crucible 11. A vertical copper conductor 17 has a lower end connected to disc 12 and an upper end connected to a source of electric current (not shown). Vertical conductor 17 is insulated with an alumina tube 18 so as to confine the anodic current to disc 12. Cathode 13 is connected in a conventional manner to the source of electric current. Cell 10 is placed in a furnace and held at a temperature at which electrolyte bath 14 is molten (e.g., 680–800° C.). The temperature of bath 14 is measured continuously with a chromel-alumel thermocouple contained in a closed-end fused alumina tube (not shown).

Cell 10 is described in detail in U.S. Pat. No. 5,284,562, cited above.

Electrolyte bath 14 comprises a mixture of fluorides and has a relatively low melting point which enables one to operate cell 10 at a relatively low temperature (e.g., 680–800° C.). The electrolyte comprises a mixture of fluorides having a eutectic or near-eutectic composition, a composition providing the lowest temperature at which the mixture of fluorides is molten. Examples of such electrolytes are described in detail in U.S. Pat. Nos. 5,006,209 and 5,284,562, both cited above.

One eutectic or near-eutectic composition consists essentially of 42–46 mol % $AlF_3$ (preferably 43–45 mol % $AlF_3$) and 54–58 mol % of either (a) all NaF or (b) primarily NaF with equivalent mol amounts of either KF or LiF or KF plus LiF replacing some of the NaF. An example of the exact eutectic composition for this embodiment of electrolyte if 44 mol % $AlF_3$ (61.1 wt. %) and 56 mol % HaF (38.9 wt. %). Another example of this embodiment comprises 46.7 mol % $AlF_3$, 36.7 mol % NaF, 8.3 mol % KF and about 8.3 mol % LiF. In parts by weight, this example comprises 66 parts $AlF_3$, 26 parts NaF, 8 parts KF and 3–4 parts LiF. A more detailed discussion of this embodiment of electrolyte composition is contained in U.S. Pat. No. 5,284,562, cited above.

Electrolyte bath 14 may have a composition containing a mixture of two eutectics comprising NaF:$AlF_3$ eutectic plus KF:$AlF_3$ eutectic plus up to 4 wt. % LiF. This electrolyte composition is discussed in detail in U.S. Pat. No. 5,006,209, cited above. Expressed in terms of the amount of individual ingredients included therein, the electrolyte consists essentially of, in wt. % adjusted to exclude impurities: 6–26 NaF, 7–33 KF, 1–6 LiF and 60–65 $AlF_3$.

Anode 12 is non-consumable at the temperatures at which cell 10 is operated. The anode has a composition consisting essentially of, in wt. %, about 25–70 copper, about 15–60 nickel and about 1–30 iron. Preferably, the anode composition consists essentially of, in wt. %, about 45–70 copper, about 25–48 nickel and about 2–17 iron. Most preferably, the anode composition consists essentially of, in wt. %, about 45–70 copper, about 28–42 nickel and 13–17 iron. A more detailed discussion of the composition of anode 12, together with a number of specific examples of anode composition, is contained in U.S. Pat. No. 5,284,562.

Cathode 13 may be composed of any suitable material that wets aluminum and that is not degraded by the molten electrolyte bath. Examples of suitable cathode materials include $TiB_2$ or a composite of $TiB_2$ and graphite (e.g., 50 wt. % graphite), or molybdenum.

Incorporated into molten electrolyte bath 14 are finely divided particles of alumina; the weight of the added alumina is typically about 5–15% of the weight of the fluoride electrolyte. The mean particle size of the alumina particles is typically about 1–10 microns, for example. A small percentage of the alumina dissolves in molten electrolyte bath 14 when cell 10 is operated in the temperature range 750–800° C. The net result is that the fluoride electrolyte bath contains about 1–2 wt. % dissolved alumina.

When current is supplied to cell 10, electrolytic reduction of alumina to aluminum occurs. Aluminum ions are attracted to cathode 13, and oxygen ions are attracted to anode 12. Metallic aluminum forms at cathode 13, and gaseous oxygen forms at anode 12. Molten metallic aluminum wets the surface of cathode 13. Bubbles of gaseous oxygen form at anode 12. Quantities of molten aluminum accumulate on the cathode 13 as a continuous phase 19 of molten aluminum.

The sequence of events described in the preceding paragraph is what desirably occurs when cell 10 is operated. However, problems occur when the cell is operated at a temperature in the range 680–800° C. One can determine whether the cell is operating in a desirable or undesirable manner by removing the cathode from the cell and inspecting it. If the cell is operating in a desirable manner, the cathode exhibits a shiny, thin layer of aluminum, with any excess aluminum dripping off with a nice sheeting action. However, when one operates cell 10 at a temperature in the range 680–800° C., the cathode, upon removal from the cell, exhibits deposits on top of a layer of molten aluminum.

In an initial set of test runs in which deposits occurred, (a) $TiB_2$ and (b) $TiB_2$/graphite composite cathodes were employed. The anode was composed of, in wt. %; 70 Cu, 15 Ni and 15 Fe. Two electrolytes were employed: (a) the eutectic composed of 44 mol. % $AlF_3$ and 56 mol. % NaF; and (b) the mixture of two eutectics comprising NaF:$AlF_3$ eutectic plus KF:$AlF_3$ eutectic plus up to 4 wt. % LiF.

The following current densities were employed in the initial set of test runs: anode current densities were in the range 0.13–0.5 A/cm$^2$; cathode current densities were 0.08, 0.3 and 1.2 A/cm$^2$. For each run, 500 g of electrolyte were used. The cathode, which measured 9.5 cm long by 2.5 cm wide by 0.6 cm thick, had 7.5 cm of its length submerged in bath 14. The bottom end of cathode 13 was maintained 1.9 cm from the top surface of anode 12. The temperature of bath 14 was maintained at 750°±2 % for the period during which current was supplied to the bath.

All of the alumina was added to bath 14 at the beginning of a run. Sufficient alumina was supplied to provide the bath with 10 wt. % undissolved (excess) alumina at the end of a run that was assumed to operate at 100% current efficiency. Because the runs never operated at 100% current efficiency, the excess alumina at the end of a run exceeded 10 wt. %.

Two types of cathode deposits were produced during this initial set of test runs. One type of cathode deposit was gray and had a relatively fine granular structure. The gray deposit was relatively hard and could not be removed by scraping with a putty knife. The aluminum below this deposit was very thin. This type of deposit is believed to be solid cryolite.

Another type of cathode deposit contained both the gray material described in the preceding paragraph and a material which was black with relatively large granules. The deposit composed of both gray material and black material, could be penetrated with a putty knife. Scraping of the deposit revealed a fairly thick coating of still-molten aluminum beneath the deposit; but the scraping could not remove the aluminum completely from the cathode, as might be expected if wetting of the cathode by the molten aluminum was unimpeded by the deposit.

The black material was often accompanied by a white material of a similar structural appearance, with a distinct interface between the black material and the white material. The white material is believed to be alumina, and the black material is believed to be a sub-oxide of aluminum, i.e. agglomerated alumina that is overall slightly deficient in oxygen and has a positive charge.

In some instances, the deposits on the cathode occurred alone; in other instances metallic aluminum was mixed with the deposits. The aluminum layer immediately adjacent the cathode surface wetted the cathode surface and was freely flowing, but the aluminum that was mixed with the deposits was not freely flowing because the deposits precluded wetting of the cathode by this aluminum. Thus, the aluminum tends to build up on a cathode having deposits thereon in balls that eventually discharge into the bath and back react yielding poor current efficiency plus a gray bath.

The deposits described above occurred when the cathode was $TiB_2$ alone and when the cathode was a composite of $TiB_2$ and graphite. The gray deposit occasionally occurred by itself, on titanium diboride, a composite of titanium diboride and graphite, or molybdenum and the cathode current density was the highest among the three cathode current densities employed (0.08 A/cm$^2$; 0.3 A/cm$^2$; and 1.2 A/cm$^2$). Otherwise, the deposits contained both the gray material and the black material.

The, deposits occurred when the electrolyte was composed of NaF: $AlF_3$ eutectic and when the electrolyte was composed of a combination of NaF:$AlF_3$ eutectic plus KF: $AlF_3$ eutectic plus up to 4 wt. % LiF. As previously noted, electrolytes having the compositions described in the preceding sentence allow the cell to operate at temperatures as low as 680° C. However, as noted above, when operating at such temperatures, deposits occur on the cathodes, and these deposits interfere with proper operation of the electrolytic reduction cell.

When deposits form on the cathode, aluminum which has separated from the cathode is found in the electrolyte as round balls, with sub-millimeter to centimeter diameters. These balls are coated with deposits which are either alumina, formed by oxidation, or electrolyte from the bath. The coatings preclude wetting of the cathode by the aluminum that has separated from the cathode and prevent agglomeration of that aluminum into a single, continuous molten aluminum phase. In contrast, when no deposits occur at the cathode, the aluminum formed on the cathode is wetted by the electrolyte, and has no coating or deposits thereon; this aluminum agglomerates into a continuous liquid phase on the cathode, and when the contents of cell 10 are dumped, the aluminum remains as a continuous phase and solidifies in a flat, lozenge-like shape.

The anode-cathode distance can be very small (e.g., about 1.25 cm). Some cells employ a cell liner made of the same metal composition as the anode, and the liner is anodic during operation. Thus, in such cells, if the cathode deposits become very thick, the anode-cathode distance is reduced, and the current density can increase. A very thick deposit can short the cell. This problem coupled with the loss of aluminum into the bath makes it important to operate the cell with an aluminum wetted cathode free of deposits.

It is believed that one cause of the deposits on the cathode is the presence of sulfur compounds. Another cause is believed to be insufficient dissolution of alumina, particularly at locations adjacent the cathode. Evidence that this is a cause is the fact that known expedients for increasing the dissolution of alumina eliminate or reduce the deposits. These known expedients are: operating at a cell temperature substantially above 800° C.; operating with a lower current density; and operating with an increased proportion of alumina in the electrolyte bath. However, all of these known expedients for increasing the dissolution of alumina have drawbacks of their own, and they are less viable options for increasing the dissolution of alumina when one wishes to electrolytically reduce alumina to aluminum in a cell of the type employed by the present invention.

As previously noted, such a cell employs: an electrolyte which is molten at temperatures in the range is 680–800° C.; a non-consumable anode having the composition described above and which is viable at a temperature in the range 680–800° C. but deteriorates more rapidly at temperatures above 800° C.; and a cathode which can be wet by aluminum and which does not deteriorate in the bath (e.g., titanium diboride, a composite of titanium diboride and graphite, or molybdenum). The electrode arrangement may comprise a multiplicity of vertically disposed, alternating, spaced apart anodes and cathodes.

When such a cell is operating in a proper manner, aluminum which forms at a cathode wets the cathode and agglomerates into a single, continuous, molten aluminum phase. This occurs when the deposits have not formed on the cathode.

In accordance with the present inventions it has been determined that the presence of catalytically small amounts of certain metals dissolved in the electrolyte bath will convert problematic low temperature systems, that have repeatedly prcoduced cathode deposits, into ideal systems. These ideal systems produce shiny, wetted cathodes; with aluminum that exhibits no coatings or deposits thereon, and collects in a continuous phase. The transition metal salt is believed to catalyze the dissolution of alumina.

The metal salt is an ingredient in the electrolytic bath and may be introduced by conversion of an elemental metal or by introduction as another compound containing the metal or both. Amounts of about 0.004 wt. % to about 0.2 wt. %, based on the weight of the molten electrolyte, have been found effective. Both a low portion of the range (about 0.004 wt. % to about 0.02 wt. %) and a relatively high portion of the range (about 0.02 wt. % to about 0.1 wt. %) have been found effective for increasing the dissolution of alumina in the bath.

Suitable metals include the transition metals nickel, copper, iron, cobalt, and molybdenum. It is projected that the desirable result produced by nickel, copper, iron, cobalt, and molybdenum will also be obtained with other metals, such as the remaining transition metals. The effectiveness of any such metal at increasing the dissolution of alumina in the bath and decreasing the formation of deposits on a cathode can be readily determined by performing a test such as one of the tests performed in the runs described below.

Compounds suitable for adding the metal ingredient to the electrolytic bath include oxides, carbonates, and fluorides (e.g., $NiF_2$, $CuF_2$, $FeF_2$, $CoF_2$, $NiCO_3$, $CuCO_3$, NiO, $Ni_2O$, $Cu_2O$, CuO). Other suitable compounds include compounds that would dissolve in the electrolytic bath.

A single metal or a plurality of metals can be introduced into the bath. The metal or metals can be introduced as pure metal powders. Pure metal plating on a cathode can be used, additionally or alternatively, to other means for introducing the metal into the bath.

Several runs were performed to determine processing parameters which were useful in reducing or eliminating deposits on the cathode and on the molten metallic aluminum which has formed on the cathode. Some of these runs are described below.

Test cell 10, described above, was used for runs 1–9. The anode was an alloy composed of, in wt. %: 70 Cu, 15 Ni, and 15 Fe. The cathode was $TiB_2$. The test run parameters were essentially the same as for the initial set of test runs described above (and which produced cathode deposits), except as otherwise indicated below. The bath composition employed in all the runs of this set was a eutectic composed of 44 mol % $A/F_3$ and 56 mol % NaF. About 500 g of the eutectic composition were employed in each run, and the cathode current density was 0.3 $A/cm^2$. Each run was operated at a temperature in the range 750–760° C. Alumina was added to the eutectic electrolyte composition before the bath was heated. At 750–760° C., the solubility of alumina in the eutectic composition is about 1–2 wt. %.

In the first run, about 10 wt. % excess (undissolved) alumina was added. Also added, prior to heating, was 2 wt. % anhydrous $NiF_2$ (10 g added to 500 g of eutectic electrolyte composition). After heating, the bath was composed of eutectic electrolyte composition, dissolved alumina, undissolved alumina and $NiF_2$. The bath was heated to 750° C. and supplied with 10 amperes of current for 80 minutes. Subsequent inspection revealed that the addition ingredient ($NiF_2$) had no discernible effect on cathode deposit formation; there were still deposits on the cathode. The bath, however, displayed a distinct green color (from the addition of the $NiF_2$). Moreover, when the contents of the cell were dumped, there was no visible sign of excess undissolved alumina.

The next run occurred several days later. The cathode employed in the first run was used for a second time without cleaning the deposits from the cathode. A fresh bath was employed. The bath contained the same eutectic electrolyte composition as the previous run, but the excess alumina content was 15 wt. % minimum. The bath was heated to 750° C. and subjected to a current of 28 amperes for 80 minutes. When the cathode was removed, it showed deposits which, over a period of about 5 minutes after cathode removal, changed in appearance by breaking and exposing white lines of material which subsequently turned yellow. Then, over a period of at least 24 hours, chemical activity was apparent on the cathode which by then was in air at room temperature. Observation with an optical microscope (60×max.) revealed gas bubbles forming at interfaces between a shiny, silver-colored phase (presumed to be aluminum) and the white/yellow material. It is believed that the gas may have been hydrogen, and that water (moisture) from the air was involved in the reactions observed to be occurring on the cathode. In any case, the activity observed to be occurring on the cathode caused the initially comparatively hard cathode deposits to become soft in comparison. Under the microscope, the cathode deposits looked like ice melting into a slush.

On a subsequent day, the third run was performed, using the same cathode as used in the previous two runs, again with no cleaning of the cathode deposits. A fresh bath was employed. The bath had the same eutectic electrolyte composition previously employed and contained 10 wt. % excess alumina. Ten amperes of current was supplied for 4.5 hours. During the run, the temperature was increased from an initial 750° C. to 760° C. for the latter part of the run. At the conclusion of the run, the cathode was removed and inspected. There were no deposits on the cathode which was shiny and coated with aluminum. The metallic aluminum which had separated from the cathode upon removal of the cathode from the bath was also shiny, indicating an absence of deposits around the quantities of aluminum which had formed on the cathode; this aluminum had agglomerated into a continuous phase of metallic aluminum. Current efficiency for this run, based on metal recovery, was 60%. (Current efficiency is the ratio of (a) metal actually recovered to (b) metal theoretically recoverable for the ampere hours employed in the run.)

The above-described third run was the first run in which the desired effect was obtained from the addition ingredient ($NiF_2$) The addition ingredient in the third run was a carryover from the first run which used 2 wt. % $NiF_2$. $NiF_2$ ingredient was added to the eutectic electrolyte bath only in the first run. No such addition ingredient was added to the bath in either of the second or third runs. The $NiF_2$ addition ingredient carried over into the third run was present in the deposits on the cathode from the first run. The same cathode was liged in all three runs without cleaning after each of the preceding runs.

A fourth run was conducted with an uncleaned cathode having previously formed deposits thereon which did not contain any of the addition ingredient ($NiF_2$). This run used the eutectic electrolyte composition described above, 10 wt. % excess alumina and 0.2 g of the bath from the first run (which contained 2% $NiF_2$). 500 g. of eutectic electrolyte composition were employed. The operating temperature was 760° C., a current of 10 amperes was supplied, and the run lasted four hours. This run produced a desirable, shiny cathode, and the current efficiency, based upon metal recovery, was 64%.

All of the subsequent runs described below employed 10 wt. % excess alumina and unless otherwise indicated, a current of 10 amperes, an operating temperature of 760° C. and a time of four or five hours.

Two more runs (numbers five and six) were conducted with fresh cathodes, devoid of deposits, and 0.2 g of the bath from the first run (containing 2 wt. % $NiF_2$). These runs did not yield shiny cathodes. It was believed that there was a lack of homogeneity in the bath from the first run, that this lack of homogeneity caused a variation in the amount of active addition ingredient ($NiF_2$) in the 0.2 g samples of bath from the first run that were added to the bath in runs four, five and six, and that runs five and, six therefore contained an amount of addition ingredient ($NiF_2$) too small to have the desired catalytic effect on the dissolution of alumina. After run six had been performed for 2 hours and 40 minutes, current flow was stopped, and an inspection of the cathode showed deposits thereon. An additional 1.5 g of the bath from the first run were then added to the bath and operation of run six was restarted. After an additional hour (for a total of 3 hours and 40 minutes), the cathode was removed from the cell, and it showed a diminution in the area of cathode coated with deposits; the bottom end of the cathode was virtually devoid of deposits.

A seventh run used 0.02 wt. % fresh $NiF_2$ (0.1 g in 500 g of electrolyte) and a fresh cathode devoid of deposits. This run produced desirable results. When the cathode was removed from the bath at the end of the run, the cathode was shiny wet. Metallic aluminum which had separated from the cathode upon pouring the bath out of the cell was present as a continuous, wetted, aluminum phase. The current efficiency based upon metal recovery was 61%.

The next two runs employed different addition ingredients. The eighth run employed 0.02 wt. % copper fluoride, $CuF_2$, in 500 g of eutectic electrolyte composition, with 10–12 wt. % excess alumina, and a fresh cathode devoid of deposits. The operating temperature was 760° C., the current was 10 amperes and the run was performed for 5 hours. Inspection of the cathode after 80 minutes revealed some degree of deposit over most of the cathode. After another 60 minutes, the deposits were breaking up, exposing shiny aluminum on the cathode. After 5 hours, the cathode was predominantly shiny, with some deposits. The metallic aluminum which had separated from the cathode when the cathode and bath were disengaged was shiny and wetted by the bath. The current efficiency was 43.5%.

The ninth run used 0.02 wt. % iron fluoride, $FeF_2$, as the addition ingredient. The operating conditions and parameters were essentially the same as those employed in the preceding (eighth) run using $CuF_2$ as the addition ingredient. The $FeF_2$ addition ingredient seemed to work the fastest of the three, yielding a clean cathode after only 140 minutes of operation, and the bath was very clear indicating an absence in the bath of unagglomerated small balls of metallic aluminum. The current efficiency for the 5 hour run was 56.6%. For the last 1.5 hours of the 5 hour run, the temperature was allowed to drop from 760° C. to 750° C., with no adverse effect.

The successful runs described above employed a current density of 0.3 $A/cm^2$. Similar success was obtained in subsequent runs employing a current density of 0.5 $A/cm^2$.

Figure 2B:
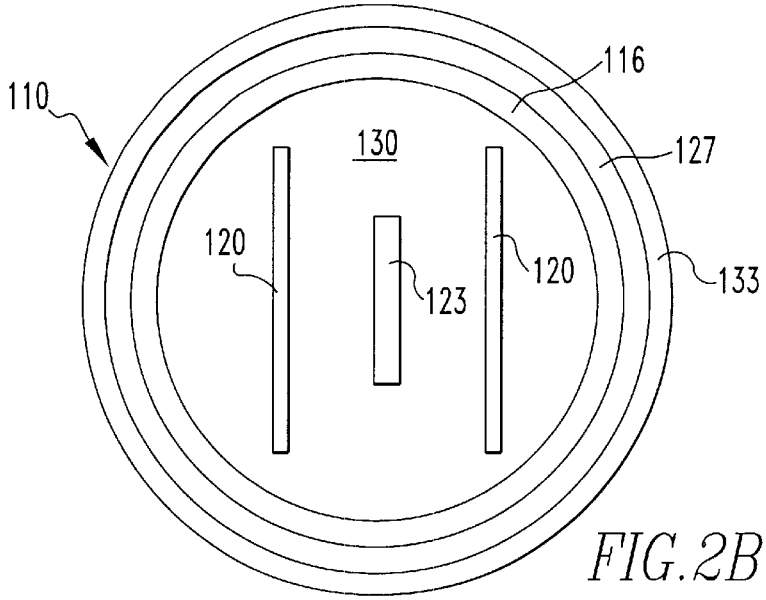
FIG. 2*b* is a plan view of the test cell shown in FIG. 2*a;*
Figure 2A:
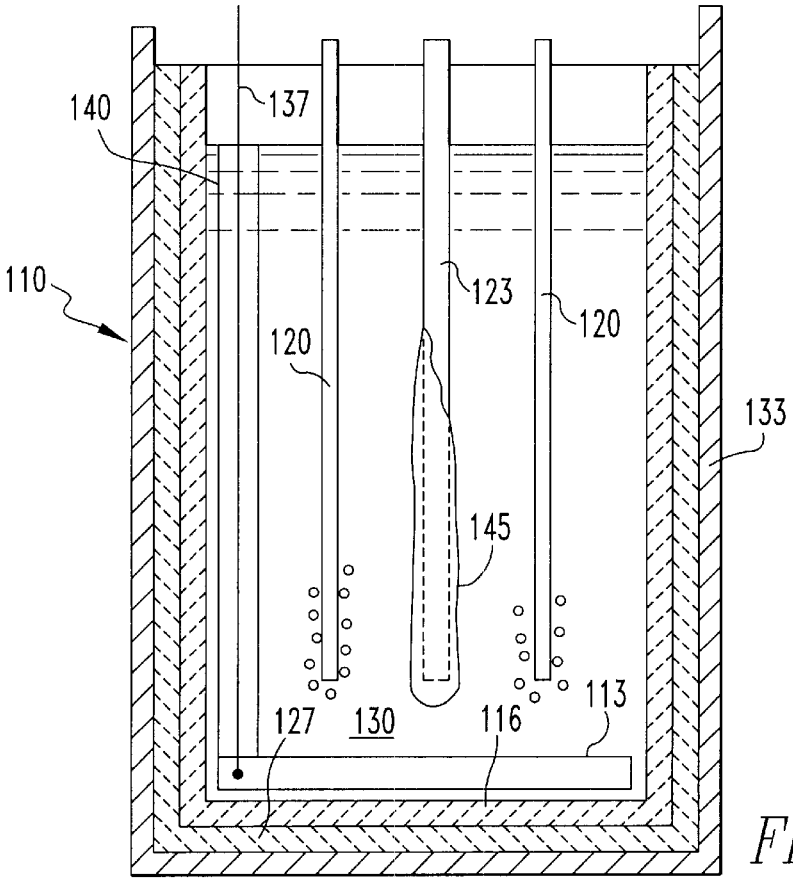
FIG. 2*a* is a vertical sectional view of another test cell employed in connection with some of the work described herein.

A tenth run employed a small cell 110 with the configuration of FIGS. 2*a* and 2*b*. The cell 110 comprised a bottom anode 113 disposed at the bottom of an alumina crucible 116. The anode 113 had a composition of: copper 70%, nickel 15%, and iron 15%. The cell 110 also comprised two side anodes 120 with the same composition as the bottom anode 113 and a center cathode 123 (the subject of this particular run). The cathode 123 was connected to an electric current source (not shown). The alumina crucible 116 was surrounded by a layer of graphite 127 and contained a bath 130. A stainless steel shell 133 around the graphite layer 127 housed the cell 110. The cathode 123 was 1.2 cm wide by 8 cm long with 6.6 cm immersed in the bath 130. Attached to the bottom anode 113 was a copper rod 137 (FIG. 2*a*) that extended out of the bath 130 and was connected to a source of electric current (not shown). The portion of the copper rod 137 in the bath 130 was sheathed in alumina 140 (FIG. 2*a*).

The cathode 123 was a $TiB_2$ cathode that had deposits on it from a previous run. Also, a small amount of previously used bath was employed, resulting in a bath containing about 0.02 wt. % $NiF_2$. The bath 130 was $AlF_3$/NaF eutectic containing about 44 mol % of $AlF_3$ and 10% excess $Al_2O_3$. The current was 10 amps and the voltage was 2.8, giving a current density of 0.36 $A/cm^2$ on the cathode 123. The crucible 116 had also been previously used. The cell 110 was operated for 172 minutes at 760° C. and 8.53 g of aluminum 145 were removed, giving a current efficiency of 89%. In FIG. 2*a*, aluminum 145 is shown wetted on the cathode 123. The test was terminated by first removing the electrodes 120, 123 and then pouring the bath 130 into a stainless steel tray. The aluminum 145 was substantially removed from the cathode 123 when the cathode 123 was removed from the bath 130. The aluminum 145 was poured out with the bath 130 and was in the form of a single ball when the bath 130 froze in the pan. The cathode 123 was wetted with aluminum 145 and was substantially free of deposits except a grey deposit at the bath line.

An eleventh run employed the same cell configuration used in the tenth run. The cell 110 had an uncleaned $TiB_2$ cathode 123 from a previous run with no new $NiF_2$ added to 500 grams of fresh $AlF_3$/NaF eutectic bath. The uncleaned cathode may have had Ni and Ni-containing compounds on it. The cell 110 was operated at 760° C. for 300 minutes at 14.3 amps and 3.1 volts, the current density on the cathode 123 was 0.5 $A/cm^2$. When poured out, 18.8 g of aluminum 145 were recovered, which corresponds to a current efficiency of 78%. The cathode 123 was substantially free of deposits.

Figure 3B:
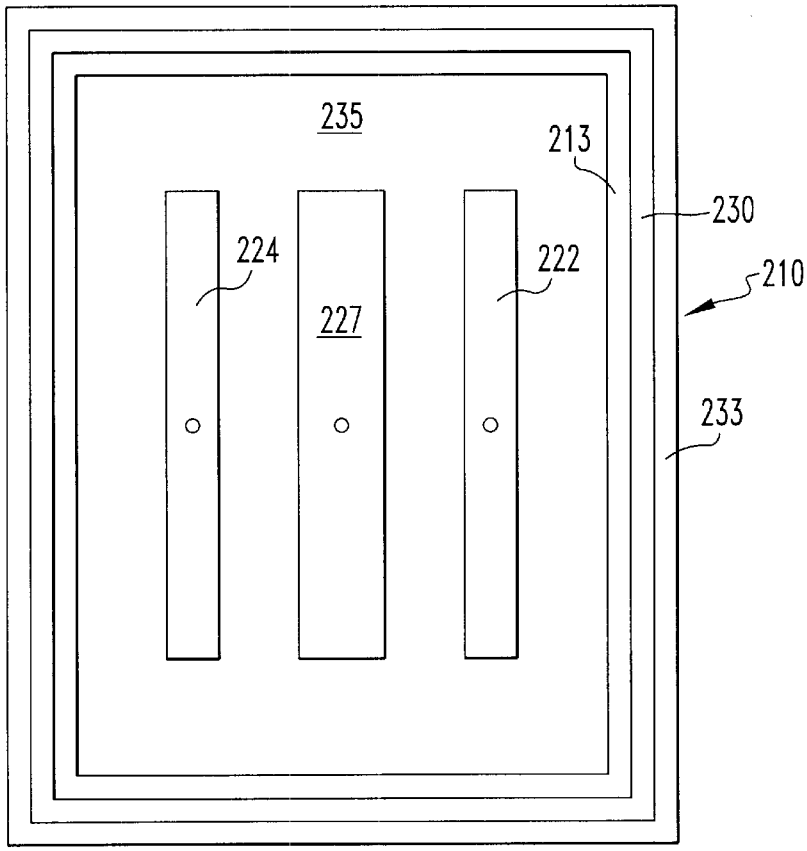
FIG. 3*b* is a plan view of the test cell shown in FIG. 3*a;*
Figure 3A:
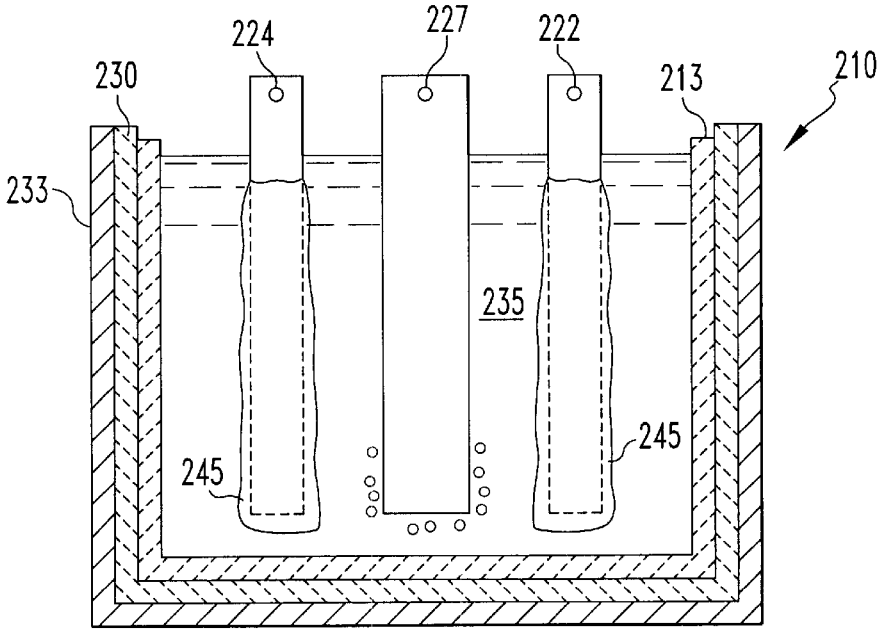
FIG. 3*a* is a vertical sectional view of another test cell employed in connection with some of the work described herein.

A twelfth run employed a larger cell 210 depicted by FIGS. 3*a* and 3*b*. The cell 210 comprised an anode liner 213, a pair of $TiB_2$ cathodes 222, 224, and one vertical anode 227 positioned between the two cathodes 222, 224. The anode-cathode distance was 1.25 cm. The composition of both the anode liner 213 and the vertical anode 227 was: Cu-70%, Ni-15%, and Fe-15%. The anode liner 213 was surrounded by insulation bricks 230, and a stainless steel can 233 encased the bricks 230.

The cell 210 was charged with 3500 grams of sodium fluoride/aluminum fluoride eutectic bath, containing 44 mol % aluminum fluoride. 350 grams (i.e., 10%) of this bath were reused from an earlier test (not described here). Prior to dilution with fresh bath, the 350 grams of used bath contained a total of about 0.1 wt. % of the fluorides of Cu, Ni, and Fe. Those fluorides came from the corrosion of an anode during an earlier run. The cell 210 thus contained a total of about 0.01 wt. % of the fluorides of Cu, Ni, and Fe at the start of the run.

The cell 210 was operated for 5 hours, after the bath 235 was melted, at a current of 200 A and a voltage of 3.5 v. The bath temperature was 755° C., the anode-cathode distance was 1.6 cm and the bath 235 contained 6% excess alumina, which was added at the rate of 89 grams per hour. In FIG. 3*a*, aluminum 245 is shown wetted to the cathodes 222, 224. At the end of the test, the cell 210 content was siphoned into a vacuum chamber (not shown). There was an aluminum ball weighing 226 grams, equivalent to a current efficiency of 67%. The cathodes 222, 224 were free of deposits up to the bath line.

For a cell having an anode liner 213 such as the cell 210 of FIGS. 3*a* and 3*b*, the anode liner 213 should have current and voltage controlled separately from the current and voltage of the vertical anode 227. This permits constant current density to be achieved, the anode liner 213 having greater surface area than the vertical anode 227.

A thirteenth run used the sare cell 210 as the twelfth run, with $TiB_2$ cathodes 222, 224, copper, nickel, and iron anodes 213, 227, and sodium fluoride/aluminum fluoride eutectic bath (44 mol % $AlF_3$) with 10% reused bath from an earlier run (not described here). As in the twelfth run, the cell 210 contained a total of about 0.01 wt. % of the fluorides of Cu, Ni, and Fe at the start of the run. In this test a conductivity probe was used to locate the aluminum 245 hanging mainly on the cathode 222, 224 bottom. The cell 210 was operated at 200 A and 3.5 volts for 5 hours. Alumina was fed at 100 grams/hour. At the end of the test, 230 g of aluminum 245 were recovered which is equivalent to a 69% current efficiency. With the conductivity probe, the metallic aluminum 245 on the cathodes 222, 224 was located by utilizing the difference in conductivity of the bath 235 and aluminum 245. This test confirmed that the aluminum 245 remained on the cathodes 222, 224 for several hours before gravity overcame the interfacial tension and the aluminum 245 started to drip off.

A fourteenth run employed the cell 110 of FIGS. 2*a* and 2*b* using 500 g of a sodium fluoride/aluminum fluoride eutectic bath from a previous run plus 0.19 g (i.e., about 0.04 wt. % of the electrolyte bath) of $NiF_2$. The same anodes 113, 120 as in the tenth run were employed uncleaned, but the current was 18 A and 3.2 volts for a cathode current density of 0.5 A/cm$^2$. The cathode employed in this run was composed of $TiB_2$ and was shaped like a cathode 270 shown in FIG. 4. The cathode 270 comprises a pair of plates 272, 274 each having a top end 277, 279 and a bottom end 282, 284, respectively. The plates 272, 274 were positioned so that a space 287 between the top ends 277, 279 was larger than a space 289 between the bottom ends 282, 284. Specifically, the space 289 between the bottom ends 282, 284 was 1 mm, a space 292 between the plates 272, 274 at a bath line 295 was 3 mm, and the space 287 between the top ends 277, 279 was about 5–6 mm. A bolt 297 positioned above the bath 130 connected the plates 272, 274, and a copper lead 298 was attached to the bolt 297 as a current lead.

The anode/cathode distance was about 1 cm. The cell 110 was operated for 3.5 hours at 760° C. Nine grams of alumina were added per hour, after starting with a 12% excess of alumina particles in the bath 130. At the end of the test, 14 g of aluminum 145 were recovered representing a 70% current efficiency. When the cathode 270 was removed, the space between the two plates 272, 274, was observed to be full of aluminum, with bath excluded, and the aluminum 145 had lifted above the bath line 295 a distance of 5 cm. It is believed that the angle between the plates 272 and 274 is a factor in determining the height to which the aluminum 145 is lifted.

A fifteenth run employed the cell 110 of FIGS. 2*a* and 2*b*, with an anode arrangement as in the tenth run. The cathode 123 comprised two molybdenum plates 1.2 cm wide by 8 cm long, and spaced apart 4 mm in a parallel arrangement. 500 g of new sodium fluoride/aluminum fluoride eutectic bath with 12% excess alumina were employed. Alumina was added at a rate of 5.6 g per hour. The current was 13 A at 4.7 volts for a current density of 0.4 A/cm$^2$. The cell 110 was operated for 3 hours. The current efficiency turned out to be indeterminate. A ball 145 of aluminum bridged the gap between the two parallel cathode plates.

A sixteenth run employed an unused $KF/AlF_3$ eutectic bath (with 45 mol % of $AlF_3$) in the apparatus of FIGS. 2*a* and 2*b*. The cell 110 was operated at a bath temperature of 685° C. No metal fluoride was added at the start. The cathode 123 was unused $TiB_2$ and the anodes 113, 120 were the same as the tenth run and uncleaned. The anode/cathode gap was 1.27 cm, the current was 14 A at 3.7 volts. The cell 110 was operated for 5 hours and the current efficiency was 33%. There were some deposits on the cathode 123.

A seventeenth run employed the cell 110 shown in FIGS. 2*a* and 2*b* having a bottom and side anodes 113, 120 and a center cathode 123. The $TiB_2$ cathode 123 was first sand blasted and then sprayed with aluminum to test the impact of having a pre-wetted (aluminum) cathode 123 to start the test. The sprayed aluminum layer was about 0.2–0.3 mm thick. The cell 110 was operated for 5 hours at 14 amps and 3 volts. The cell 110 started with an excess of aluminum oxide of about 12%, and freshly prepared bath 130 (sodium fluoride/aluminum fluoride eutectic). No transition metal ingredient was added to the bath. The aluminum 145 yield was 14 grams for a current efficiency of 60%. At the end of the test, the bottom ⅔ of the cathode 123 was clean, with only an aluminum coating. The top ⅓ of the cathode 123 had black deposits coating it. Starting with a pre-wetted cathode 123 did not prevent some deposits.

An eighteenth run is an example of a test where cathode deposits were obtained. The cell was like the cell 10 shown in FIG. 1 and had an anode that was on the bottom and a cathode positioned vertically above the center of the round bottom anode. The anode was formed of sintered copper, iron, and nickel (70/15/15) and the cathode was $TiB_2$/graphite. In this test the alumina feed was ground to a fine powder to facilitate dissolution. The cell started with freshly cleaned electrodes and new bath. No metal fluoride was added at the start of the test. The bath comprised a eutectic mixture of sodium fluoride/aluminum fluoride and potassium fluoride/aluminum fluoride plus 4 wt. % lithium fluoride. 10% excess alumina was in the bath at the start. The cell was operated for 4.4 hours at 750° C. at 10 A and 3.1 volts. The current density was 0.39 A/cm$^2$ on the cathode. During the test the evolution of oxygen was non-uniform over the surface and there was considerable back reaction of aluminum. Sparking at the surface was observed. On examination at the end of the test, the cathode had a little aluminum on the bottom but the rest was coated with deposits. The aluminum recovered was 1.2 grams for a current efficiency of 8%:

In a nineteenth run, 750 g of bath was pretreated with a single 45 g piece of aluminum. The bath was the eutectic bath comprising 519 g of $AlF_3$ and 277 g of NaF. The mixture was heated to 764° C. for 3 hours. The bath chemicals and the 45 g of aluminum were all smelter grade and contained some sulfate and phosphate. On heating there was a vigorous reaction of the bath and aluminum with strong gas evolution. The reaction consumed 1 gram of the aluminum. The bath became very clear and was white on freezing with a distinct but small layer of grey material that settled out. The gas appeared to be oxides of sulfur.

500 g of this bath was used with 0.04 wt. % of metal fluoride (0.02 wt. % $NiF_2$ and 0.02 wt. % $CrF_2$) in the cell of FIGS. 2*a* and 2*b*. A cathode 123 made of $TiB_2$ was used and the anodes 113, 120 had a copper, nickel, iron percentage of 70%, 15%, 15%. The cell 110 was operated for 5 hours at 765° C. at a voltage of 3.0 and a current of 20 amps. The cathode current density was 0.35 A/cm$^2$, and the anode current density was 0.18. The cathode 123 was entirely wetted, with only slight patches of bath chemicals coating the aluminum 145 when cool. A current efficiency of 89% was achieved. The pretreatment of the bath 130 to remove impurities such as aluminum sulfate and/or other sulfur compounds appears to cause a significant improvement in (a) eliminating cathode deposits and (b) current efficiency compared to just employing an initial amount of additive (e.g., an active metal fluoride).

When a cell is started with uncleaned bath chemicals using cathodes previously used and coated with aluminum, a similar reaction occurs before the power is turned on. That is, pretreatment of the bath occurs, removing impurities such as aluminum sulfate and/or other sulfur compounds, before the power is turned on, resulting in a bath substantially free of sulfur compounds. This appears to explain why better results can be obtained employing previously used cathodes with an aluminum coating.

Eliminating some of the impurities, such as aluminum sulfate and/or other sulfur compounds, in the bath chemicals may give superior results. However, the impurities are really a start-up problem that shows up in short tests such as those runs described above in which fresh chemicals were used each time. For commercial applications it is believed that the impurities are not a problem because of longer operation times.

As shown above, starting the 300 amp test cell shown in FIGS. 3*a* and 3*b* with new anodes, cathodes, and bath, resulted in a thick cathode deposit and no recovered aluminum. This poor result was attributed initially to poor bath composition. Starting the smaller cell, shown in FIGS. 2*a* and 2*b*, with clean cathodes, not coated with anything, usually resulted in: cathodes coated with deposits, grey bath, and poor current efficiency. Changing bath composition, current density, and free suspended alumina concentration made no significant difference in preventing the formation of cathode deposits. High current density caused grey cryolite deposits.

At other conditions, black deposits were obtained, with entrained aluminum balls, on the cathode and in the bath. The bath was dark, with sparks from igniting aluminum on the surface. By increasing the temperature from 750°–760° C. to 800°–850° C., wetted cathodes were obtained. But deposits were obtained on top of aluminum wetted cathode surfaces. The problem is believed to be caused by insufficient aluminum-containing ions in the cathode boundary layer.

An experiment where. 2% $NiF_2$ was added to the bath did not result in any improvement in cathode performance. Reusing a small amount of this bath and dirty cathode with fresh bath chemicals resulted in a clean wetted cathode and improved current efficiency. When the bath was melted with a previously used cathode, the cathode coating dissolved, delivering the deposited aluminum, nickel, and other metals to the bath, resulting in clean cathodes. Small amounts. of $NiF_2$, $CuF_2$, $FeF_2$, $CoF_2$ and $MoF_2$ all had the same effect of promoting clean cathodes. Despite the addition of these metal fluorides, black cathode deposits appeared in the first ½ hour to 1 hour of operation, but that after 2 or so hours the deposits substantially disappeared, having either sloughed off or dissolved. Adding the metals as the oxide or carbonate of the metals also helped remove the deposit, but more slowly.

While nickel seems to perform better initially, on longer running it disappears from the bath in detectable levels, due partly to volatilization, but is found on the cathode in detectable levels. Testing a bath with 0.02 wt. % $NiF_2$ without electrolysis, showed the nickel fluoride disappeared in about 30 minutes through volatilization.

When copper or iron is present as an ingredient, the copper or iron is found in the bath on a continuing basis at concentrations of about 0.02 wt. % for iron and about 0.07 wt. % for copper. The corrosion of the anode into the bath supplies these ions in approximately those amounts.

The concentration of nickel fluoride that is added at the start is typically in the range of 0.004–0.02 wt. %. The concentrations may be close to the solubility of the oxides in the bath. Increasing the amount of nickel on start-up to say 0.2 wt. % is no more effective in preventing deposits. Because the anode is a mixture of copper, nickel, and iron (70/15/15 or 60/25/15, etc.) there is a continuing supply of these ions to the bath as the anode metals oxidize and then dissolve in the bath. It is not understood why some metal fluorides (Ni, Co) perform better initially unless they tend to concentrate near the cathode and recycle in the boundary layer.

Another factor that is important in preventing cathode, deposits is the particle size of the alumina fed to the cell. The use of normal smelter grade ore with larger particles (100 microns) leads to cathode deposits even when metal fluorides are added at the start. Ground alumina ore works much better, particularly ore having a mean particle size, expressed as equivalent spherical diameter, between about 1 micron and about 10 microns, and even more particularly between about 1 micron and about 2 microns. During operation the $Al_2O_3$ particles are being continuously dissolved, and the size of some are very small, even as new feed is being added. A criterion to consider is the $Al_2O_3$ particle size distribution when the bath reaches equilibrium.

As discussed above in greater detail, three suitable bath compositions to be used with the transition metal ingredient are a) $NaF/AlF_3$ eutectic (M.P. about 704° C.)

b) $KF/AlF_3$ eutectic (M.P. about 595° C.)

c) $KF/AlF_3$ eutectic+$NaF/AlF_3$ eutectic+4%$LiF_3$ (M.P. about 695° C.)

The electolyte can consist essentially of $NaF/AlF_3$ eutectic and the metal ingredient. Alternatively, the electrolyte can consist essentially of $KF/AlF_3$ eutectic and the metal ingredient. Alternatively, the electrolyte can consist essentially of $KF/AlF_3$ eutectic+$NaF/AlF_3$ eutectic+4% $LiF_3$ and the metal ingredient. Any of these baths also include dissolved alumina which is typically present in the amount of 1–2 wt. %. These baths typically have an undissolved alumina content in a range of about 5 wt. % to about 15 wt. based on a total weight of the electrolyte bath.

Although these three baths differ greatly in melting point, melting point did not appear to make a major difference in the formation of cathode deposits. The reason may be that the solubility of alumina is comparable in each bath at the bath operating temperatures. Operating the $KF/AlF_3$ bath at 730° C. led to cleaner cathodes than when the bath temperature was 685° C. The higher temperature provided more superheat above the minimum melting point. It was also important to maintain the mol percentage of $AlF_3$ at an adequate level (44%–46%), and it may be necessary to periodically add make up.

The low melting point of the $KF/AlF_3$ eutectic bath allowed operation at a lower temperature, about 685° C. to 730° C. vs. 760° C. for the $NaF/AlF_3$ eutectic. At 685° C., the deposits on the cathode were not extensive when the $KF/AlF_3$ eutectic bath was used, and looked more like cryolite than the black material typically seen. At 730° C., cathode deposits nearly disappear.

The bath can be maintained at a temperature below about 950° C. More particularly, the bath can be maintained in the following temperature ranges: about 850° C. to about 900° C.; about 680° C. to about 800° C.; and about 730° C. to about 760° C.

A high current density on the cathode can cause cryolite deposits. Too low a current density on the anode can lead to muck settling to the bottom due to inadequate oxygen liberation to keep alumina suspended. A current density of from about 0.2 $A/cm^2$ to about 0.6 $A/cm^2$ on both anode and cathode is sufficient, and from about 0.4 $A/cm^2$ to about 0.6 $A/cm^2$ is preferred.

It can be important to eliminate temperature gradients at the bath surface by reducing the area of the electrodes above the bath surface and adequately insulating the top of the cell. This system operates without a frozen crust, so that surface loss must be avoided by other means.

To confirm that a cathode could be reused repeatedly largely without deposits, some of the runs employed recycled cathodes from runs that had resulted in good cathode wetting. In the previous runs, a metal fluoride was used to help eliminate deposits. In the subsequent tests, the cathodes were reused without cleaning, and employed no additional metal fluorides. These runs also resulted in sulfur removal and in clean cathodes. Similarly, the re-use of bath from a previous test usually gave good results with as little as 10% of the bath being reused.

The aluminum produced remained in contact with the cathode, and did not start to drop off for several hours. The aluminum recovered had remained on the cathode until the cell was poured or siphoned out at the end of the test. With $TiB_2$ cathodes, 3–4 hours of production remained on the cathode through interfacial tension. Tests made under the same conditions for equal time periods produced nearly identical amounts of aluminum. It appears to be necessary to remove the aluminum from the cell before it leaves contact with the cathode. The substantial retention of aluminum on the cathode provides is a pool of metal available for periodic or continuous removal. The amount stored by the cathode can be enhanced by the cathode structure (e.g., the cathodes of FIGS. 4 and 5*a*).

Differing aluminum retention with each cathode material and bath, may be due to different interfacial tension. Three types of cathode materials were used in the examples above: $TiB_2$, a $TiB_2$/graphite composite, and molybdenum. Differing current efficiencies were observed from wetted cathodes of the three materials operated for the same length of time without aluminum removal during the test run The current efficiency is measured by comparing the amount of aluminum metal recovered to the amount of energy used in the test.

The amount of interfacial tension between the aluminum and the cathode is not particularly important when continuous removal of aluminum from the cathode is performed because the aluminum does not accumulate to an extent great enough for aluminum to fall off of the cathode and back react. When continuous removal of aluminum is not performed and the aluminum is allowed to accumulate on the cathode, it is believed that the interfacial energy between the aluminum and the cathode is a factor in determining the maximum amount of aluminum suspended upon the cathode and, therefore, the maximum current efficiency attainable.

In order to remove aluminum metal without also removing bath, it can be necessary to accumulate a significant pool of aluminum on the cathode. Since aluminum wets the cathode (under good operating conditions), the aluminum collected in large drops or pools. Since the density of aluminum is slightly greater than the density of the bath, it collects most heavily at the bottom of the cathode. In one test with a 300 amp cell, about 125 g of aluminum was found hanging on the bottom edge of each of the $TiB_2$ cathodes. The cathodes were 10 cm wide by 1 ¼ cm thick. With good control of operating conditions, current efficiencies of 70–80% have been obtained, indicating a high retention of aluminum metal on the cathode.

In another embodiment, employed in the fifteenth run, parallel molybdenum cathode elements were placed 4 mm apart. Aluminum bridged the gap between the parallel plates. Essentially, the space between the plates formed a reservoir. It is believed that any other suitable cathode materials would work in a similar parallel element arrangement.

Figure 4:
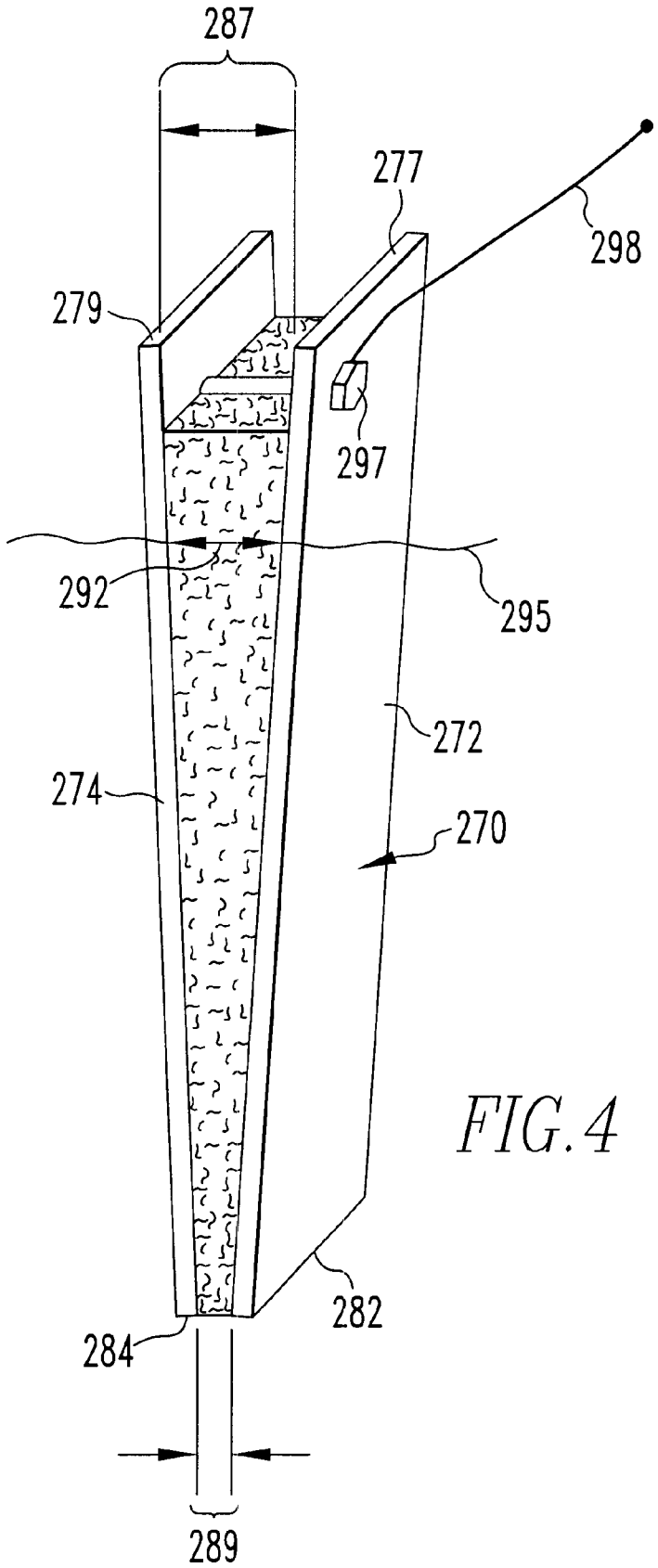
FIG. 4 is a perspective of an embodiment of a cathode.

In another embodiment, shown in FIG. 4 and employed in the fourteenth run, $TiB_2$ cathode elements were positioned in the shape of a V with an opening at the bottom and a wide opening at the top. The cathode was positioned above an anode and was surrounded by anodes at the sides. In this embodiment the aluminum climbed above the bath surface between the elements by interfacial tension. Cathodes having an inverted V shape as well as cathodes composed of other materials are projected to work well.

Figure 5A:
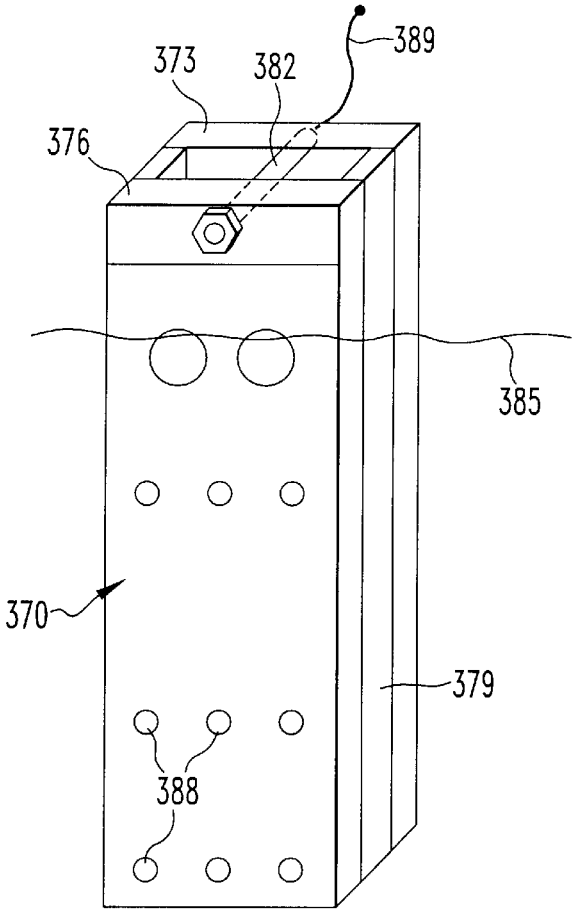
FIG. 5*a* is an isometric view of another cathode embodiment.
Figure 5B:
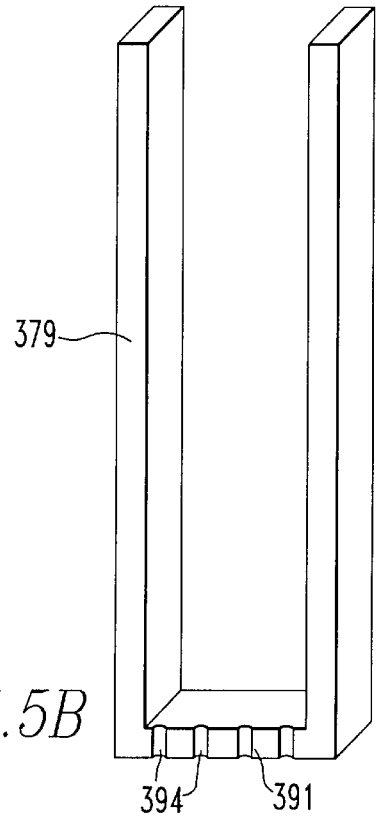
FIG. 5*b* is an isometric view of a spacer member of the cathode of FIG. 5*a*.

FIGS. 5*a* and 5*b* disclose an alternative cathode 370 that may be used in accordance with the present invention. The cathode 370 comprises two face plates 373, 376 and a spacer member 379 positioned therebetween. A bolt 382 extends through and connects the two face plates 373, 376, thereby holding the spacer member 379 therebetween. Example dimensions include a 9.5 cm length for the spacer member 379, 7.5 cm of which is immersed in the bath (see bath line 385), a 3 cm width, and a 2.5 mm thickness (i.e., the face plates 373, 376 are spaced apart by 2.5 mm). Holes 388 are drilled in the two face plates 373, 376 and the holes can be 2 mm in diameter. An electrical lead 389 is attached to the bolt 382. A bottom edge 391 (FIG. 5*b*) of the spacer member 379 has grooves 394 (FIG. 5*b*) to attract aluminum that runs down the face of the cathode 370. The cathode 370 is hollow and provides a reservoir for the accumulation of molten aluminum. The cathode 370 may be fabricated from any suitable cathode material including molybdenum.

The process of separating aluminum from vertically disposed cathodes requires operation that allows the cathode to be wetted with aluminum without deposits of bath materials, and allows the withdrawal of the aluminum directly from the cathode.

This continuous liquid aluminum phase can be removed by siphoning, in a manner disclosed in U.S. Pat. No. 5,284,562, cited above. In accordance with another embodiment of the present invention, the aluminum which forms on the surface of the cathode can be removed directly from the cathode by an arrangement which precludes breaking direct electrical contact between the aluminum and the cathode, so that the aluminum remains cathodic.

Two suitable ways of removing aluminum from the cathode directly are siphoning and interfacial tension. Siphoning can be used to remove aluminum from between the plates, in a V-shaped cathode, or to remove aluminum from the surface of a solid cathode. Either way, the siphoning can be performed while the cell is operating so that aluminum does not fall off of the cathode and back react. If the aluminum is pulled above the surface of the bath by interfacial tension, then a siphon might be self-starting. Otherwise, a vacuum can be used to start the siphon.

In summary, one may properly conclude from the runs described above that the problematic deposits on the cathode can be effectively reduced or eliminated by employing about 0.004–0.2 wt. % of a metal salt(e.g., fluorides of Ni, Cu, Fe, Co, and Mo) in a bath having an operating temperature in the range 680–850° C. over a time period of about 4 to 5 hours. The metal ingredient acts as a catalyst. Operation of a cell in accordance with the present invention can maintain a clean cathode devoid of deposits. Should depletion of the metal ingredient occur over a long period of operation, it can be readily replenished merely by adding it to the bath. Removal of sulfur is also effective at minimizing deposits and can increase current efficiency.

As stated above, a cell operated in accordance with the present invention not only prevents cathode deposits but also prevents deposits around the quantities of aluminum on the cathode, thereby allowing that aluminum to agglomerate into a continuous liquid aluminum phase. Aluminum has a near neutral density in the bath and as long as the cathode is wetted the interfacial tension allows it to adhere to the cathode.

Some copper, iron, and nickel enter the bath during the operation of a cell having a copper/iron/nickel anode. However, the amount of those metals entering the bath depends upon the amount of time the cell is operated. In order to have the benefit of the metal ingredient at the beginning of a run, the metal. ingredient should be added to the bath prior to operation. This way, cathode deposits can be, minimized before metal from the anode even reaches a level that can prevent such deposits.

In another embodiment of the present invention, one may add, to the bath in the cell, one or more alloying ingredients for the aluminum. These alloying ingredients, added as pure metal, will metallurgically combine with the aluminum produced by the alumina reduction process and be part of the continuous liquid phase consisting primarily of aluminum. The procedure described in this paragraph would be applicable to aluminum based alloys in which the aluminum content was in excess of 90%, for example. The alloying ingredients contemplated here include the metals employed as catalytic addition ingredients, in which case sufficient additional amounts above that required for the catalytic effect would be required. In addition, alloying ingredients other than the metals described above could be utilized in this embodiment of the present invention.

The alloying procedure described in the preceding paragraph would have an advantage over the conventional alloying procedure which requires a process separate and apart from the electrolytic reduction of alumina to aluminum. A problem encountered in the conventional two-process method is that the alloying ingredient can accumulate near the skin of the aluminum base alloy when the latter has solidified. It is believed that accumulation of alloying ingredient near the skin of the solidified alloy would be avoided when the alloying ingredient is added as part of the bath employed in the electrolytic reduction of alumina to aluminum.

As noted above, the catalytic transition metal ingredient enhances the dissolution of alumina at the low temperatures (680–760° C.) at which the eutectic bath composition is still molten. This property may also be exploited in high temperature electrolyte baths to facilitate the dissolution of alumina therein. In other words, incorporating the addition ingredients described above into high temperature electrolyte compositions operating at temperatures in the range 850–900° C. will facilitate the dissolution of alumina in those electrolytes, an effect which is desirable.

Normally, as alumina is electrolytically reduced to aluminum in a cell, the depleted alumina is continually replenished by the addition of fresh alumina to the bath while the cell is operating. In those instances where the catalytic addition ingredient also has to be replenished, it can be added to the bath with the replenishing alumina. This replenishment procedure may be particularly cost effective if the catalytic addition ingredient is a metal fluoride, and if a dry scrubber employing alumina is used to remove hydrogen fluoride (HF) from off-gases produced by the electrolytic reduction cell, a cell that employs fluorides as the electrolyte.

In such a scrubber, the off-gases from the cell are directed through a bed of alumina particles that collect volatiles, such as HF, emanating from the bath. In accordance with an embodiment of the present invention, the metal for the metal fluoride of the catalytic addition ingredient could be added as a dry metal powder to the alumina employed in the dry scrubber. During the scrubbing action, metal powder would be converted to metal fluoride; this would be an inexpensive procedure for producing the metal fluoride. The fluoride enriched alumina/metal from the dry scrubber could then be introduced into the bath of the electrolytic reduction cell, thereby replenishing both the alumina and the fluoride catalytic addition ingredient. This technique would be a variation of a presently employed technique that uses fluoride-enriched alumina from the dry scrubber to adjust the fluoride content in an electrolytic reduction cell.

The foregoing detailed description has been given for clearness of understanding only, and no unnecessary limitations should be understood therefrom, as modifications will be obvious to those skilled in the art.

We claim:

1. A combination for use in the electrolytic reduction of alumina to aluminum using an anode and a cathode, said combination comprising:

a vessel;

a bath contained within said vessel and comprising the following ingredients:

(a) a molten salt electrolyte consisting essentially of $AlF_3$ and at least one salt selected from the group consisting of NaF, KF, and LiF; and (b) about 0.004 wt. % to about 0.2 wt. %, based on total weight of the molten electrolyte, of at least one transition metal or at least one compound of said metal or both provided in said electrolyte prior to using said electrolyte in electrolytic reduction of alumina to aluminum to improve wettability of said cathode with molten aluminum;

said bath having a density less than that of molten aluminum and less than that of alumina;

at least one non-consumable anode in said bath and at least one dimensionally stable cathode in said bath, with a space defined between said anode and said cathode; and means for introducing alumina particles into said bath;

said cathode comprising means for accumulating molten aluminum that has been electrolytically reduced from alumina in said bath.

2. The combination of claim 1 wherein ingredient (b) is present in the range of about 0.004 wt. % to about 0.02 wt. %.

3. The combination of claim 1 wherein ingredient (b) is present in the range of about 0.02 wt. % to about 0.1 wt. %.

4. The combination of claim 1, and further comprising means for withdrawing molten aluminum accumulating at the cathode, to remove the molten aluminum from the vessel.

5. The combination of claim 1 wherein the compound is selected from the group consisting of fluorides, oxides, and carbonates.

6. The combination of claim 1 wherein ingredient (b) comprises a plurality of transition metals.

7. The combination of claim 1 wherein the metal is selected from the group consisting of nickel, iron, copper, cobalt, and molybdenum.

8. The combination of claim 7 wherein the compound is an oxide.

9. The combination of claim 7 wherein the compound is a fluoride.

10. The combination of claim 7 wherein the compound is a carbonate.

11. The combination of claim 1 and further comprising alumina particles in said bath.

12. The combination of claim 11 wherein:

the bath has an alumina content in a range of about 5 wt. % to about 15 wt. % based on a total weight of the bath.

13. The combination of claim 1 wherein:

said anode is composed of Cu—Ni—Fe alloy.

14. The combination of claim 1 wherein the electrolyte bath consists essentially of $NaF/AlF_3$ eutectic.

15. The combination of claim 1 wherein the electrolyte bath consists essentially of $KF/AlF_3$ eutectic.

16. The combination of claim 1 wherein said molten electrolyte consists essentially of, in wt. % adjusted to exclude impurities:

| | |
|---|---|
| NaF | 6–26 |
| KF | 7–33 |
| LiF | 1–6 |
| $AlF_3$ | 60–65 |

17. The combination of claim 16 wherein the electrolyte bath consists essentially of $NaF/AlF_3$ eutectic, $KF/AlF_3$ eutectic, and 4 wt. % LiF.

18. The combination of claim 1 wherein the cathode is composed of a material selected from the group consisting of $TiB_2$, a composite of $TiB_2$ and graphite, and molybdenum.

19. The combination of claim 1 wherein means is disposed in the bath for removing sulfur which comprises metallic aluminum added to said bath prior to electrolyzing said bath to reduce alumina to aluminum.

20. The combination of claim 1 wherein the bath is substantially free of sulfur-containing compounds.

* * * * *